US005628504A

United States Patent [19]

Lyga

[11] Patent Number: 5,628,504

[45] Date of Patent: May 13, 1997

[54] SIDE GUIDE FOR A MAIL HANDLING MACHINE

[75] Inventor: Thomas M. Lyga, Torrington, Conn.

[73] Assignee: Pitney Bowes Inc., Stamford, Conn.

[21] Appl. No.: 356,817

[22] Filed: Dec. 15, 1994

[51] Int. Cl.[6] ..... B65H 9/04

[52] U.S. Cl. ..... 271/171; 271/253

[58] Field of Search ..... 271/144, 171, 271/223, 253

[56] References Cited

U.S. PATENT DOCUMENTS

| | | | |
|---|---|---|---|
| 3,855,041 | 12/1974 | Kunisch | 156/442.2 |
| 4,348,249 | 9/1982 | Denzin | 156/442.2 |
| 4,371,416 | 2/1983 | Denzin | 156/441.5 |
| 4,850,580 | 7/1989 | Denzin | 271/2 |
| 4,930,764 | 6/1990 | Holbrook et al. | 271/119 |
| 5,112,037 | 5/1992 | Holbrook | 271/2 |
| 5,145,164 | 9/1992 | Kan | 271/171 X |

*Primary Examiner*—F. J. Bartuska

*Attorney, Agent, or Firm*—Steven J. Shapiro; Melvin J. Scolnick

[57] ABSTRACT

A side guide for a mailing machine includes a main wall, a secondary wall spaced from the main wall and moveable between an operative position and an inoperative position, and structure for allowing movement of the main and secondary walls in a direction transverse to movement of mailpieces passing through the mailing machine. The side guide operates such that at times when the secondary wall is in the operative position it is moveable in the direction transverse to movement of mailpieces via the structure to abut against mailpieces having a width within a first predetermined width range and at times when the secondary wall is in the inoperative position the main wall is moveable in the direction transverse to movement of mailpieces via the structure to abut against mailpieces having a width within a second predetermined width range that is different from the first predetermined width range.

4 Claims, 3 Drawing Sheets

SIDE GUIDE FOR A MAIL HANDLING MACHINE

BACKGROUND OF THE INVENTION

1. Field of the Invention

This invention relates to a side guide for a feeder section of a mail handling machine, and in particular to a side guide capable of eliminating mailpiece skew for large and small sized mailpieces.

2. Description of the Related Art

U.S. Pat. No. 4,930,764 issued to Holbrook et al., and U.S. Pat. No. 5,112,037 issued to Holbrook, are both assigned to the assignee of the instant application and are each directed to a front end feeder for a mail handling machine. In each of the aforementioned patents, which are hereby incorporated by reference, the front end feeder includes a hopper region with a deck which is substantially flat and in which is embedded a series of drive wheels which are angled toward a rear registration wall. Moreover, the deck is angled slightly backwards and slightly towards the rear registration wall. When a stack of envelopes intended to be sealed and posted in the mailing machine are loaded into the hopper region, the function of the front feeder is to pre-shingle the mail while concurrently moving it downstream toward a singulator located downstream of the hopper region. The orientation of the deck and the drive wheels are designed to ensure that the mailpieces being processed in the mailing machine are maintained in registration with the rear registration wall as they approach and enter the singulator. Furthermore, U.S. Pat. No. 5,112,037 discloses a plurality of fixed steps which are disposed on the top surface of the deck to provide additional tilting and guidance of wide mailpieces to prevent mis-registration.

While the apparatus described in the above-identified patents perform extremely well for most mailpieces being processed through the mail handling machine, experience has shown that some very small and thin pieces of mail tend to obtain a natural curve therein such that these mailpieces are not adequately urged toward the registration wall and are subsequently presented to the singulator in a skewed orientation. Moreover, it is conventional for large pieces of mail such as, for example, those measuring nine inches by twelve inches to be fed through the mail handling machine along their longitudinal direction. The previously identified patents register these large pieces of mail quite well. However, users of mail handling machines are ever increasingly sending these large pieces of mail through the mail handling machine along the direction of their shorter length. Mail which is processed through the mail handling machine in this fashion is referred to as "portrait mail". In this situation, the drive wheels are sometimes ineffective in registering the portrait mail against the rear registration wall such that the portrait mail is presented to the singulator in a skewed orientation. In both of the above-mentioned situations, if the mailpiece is presented to the singulator in a skewed orientation, it will pass through subsequent operational sections (for example, flap moistening, flap sealing, weighing, indicia printing) of the mail handling machine in a skewed orientation thereby negatively impacting the operation of these subsequent operational sections. Accordingly, a device is needed to ensure that small, thin pieces of mail and large pieces of mail processed as portrait mail are assuredly registered against the rear registration wall of a mail handling machine. However, since the drive wheels extend above the surface of the deck of the front feeder, they present a significant obstacle in designing a side guide which can be used to register a full spectrum of mailpiece widths such as, for example, those ranging from four inches to thirteen and one-half inches in width. Thus, a side guide is needed which can be adjusted to accommodate the full range of mailpiece widths while avoiding interference with the drive wheels.

SUMMARY OF THE INVENTION

It is an object of the invention to provide a side guide which is capable of maintaining mailpieces, varying in width size from small to large, in proper registration as they pass through a mail handling machine.

It is yet another object of the invention to provide a side guide capable of registering mailpieces of varying width in a mail handling machine having a front end feeder in which drive wheels are disposed above a top portion of the front end feeder deck.

The above objects are met by providing a side guide for a mailing machine, the side guide including: a main wall; a secondary wall spaced from the main wall and moveable between an operative position and an inoperative position; and means for allowing movement of the main and secondary walls in a direction transverse to movement of mailpieces passing through the mailing machine. The inventive side guide operates such that at times when the secondary wall is in the operative position, it is moveable transverse to the movement of the mailpieces via the allowing means to abut against mailpieces ha ring a width within a first predetermined width range, and at times when the secondary wall is in the inoperative position the main wall is moveable transverse to the movement of the mailpieces via the allowing means to abut against mailpieces having a width within a second predetermined width range. The first and second predetermined width ranges are different than each other.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
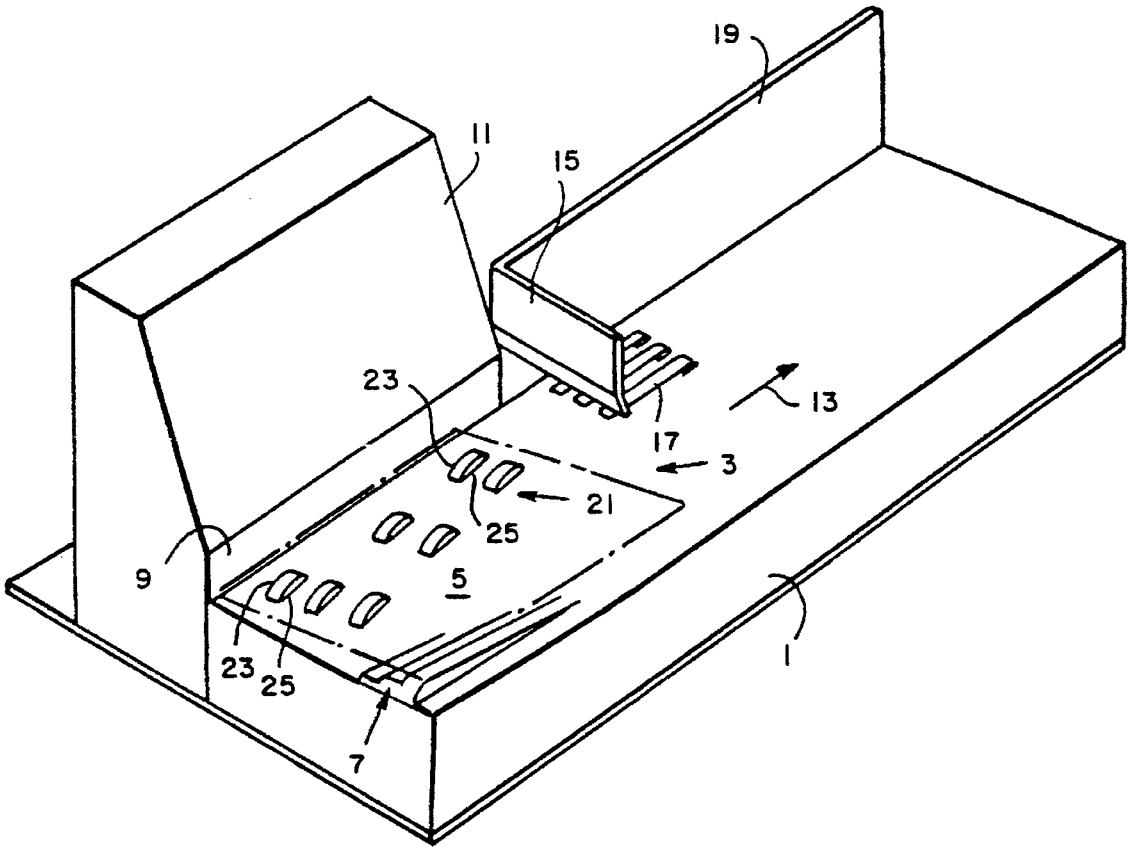
FIG. 1 (PRIOR ART)
FIG. 1 is a perspective view of a conventional front end feeder of a mail handling machine.

A conventional front end feeder of a mail handling machine is shown in FIG. 1 and includes a base member 1 along the top of which at the left end is provided hopper area 3 for receiving a stack of mail to be processed. Overlying the top of the base member 3 is a deck S which for the most part is flat except for three step portions generally indicated at 7. Deck 5 can have a small backward tilt (to the left in FIG. 1) which assists in pre-shingling the mail, as well as a small slant toward the rear of the mailing machine. The rear of the deck 5 is defined by a registration wall 9 which extend s vertically along side the edge of deck S. Registration wall 9 can be part of a tamper subsystem 11 which is useful for tamping overlying envelope flaps as unsealed mailpieces are fed downstream in the mailing machine. The downstream direction of the mailing machine is indicated by arrow 13. Downstream of hopper area 3 is structure 15 for guiding mailpieces downstream. A transport mechanism 17 represented by three belt drives illustrated for a singulator (not shown) is also disposed downstream of hopper area 3. Further downstream, deck 5 is closed off at its rear by a wall 19 which serves as a registration wall for the edge of the processed mailpiece passing thereby.

Transport means 21 are provided in hopper area 3 for moving the mailpieces in the downstream direction. The transport means includes seven friction drive wheels 23 mounted for rotation in the deck 12. The top surfaces of each of the friction drive wheels 23 extend through deck 5 via corresponding openings 25 such that the top surface of each of the seven friction drive wheels 23 is disposed above the surface of the deck 5.

The above described front end feeder portion of the mailing machine works relatively well for most mailpieces. However, as previously discussed, very small and thin mailpieces and large portrait mailpieces often do not remain properly registered and thus are fed into transport mechanism 17 in a skewed position. When this happens, the skewed mailpiece can no longer be properly processed by the remainder of the mail handling machine and will generally cause the mail handling machine to operate improperly or come to a halt.

In accordance with the instant invention, structure is provided in the hopper area 3 to ensure that, in a preferred embodiment, mailpieces ranging in width from approximately four inches to thirteen and one half inches remain properly registered against registration wall 9. In accordance with a preferred embodiment of the invention, this additional structure includes a side guide generally indicated at 27 (FIGS. 2, 3) which is movable in a direction transverse to the downstream flow of mailpieces.

Figure 2:
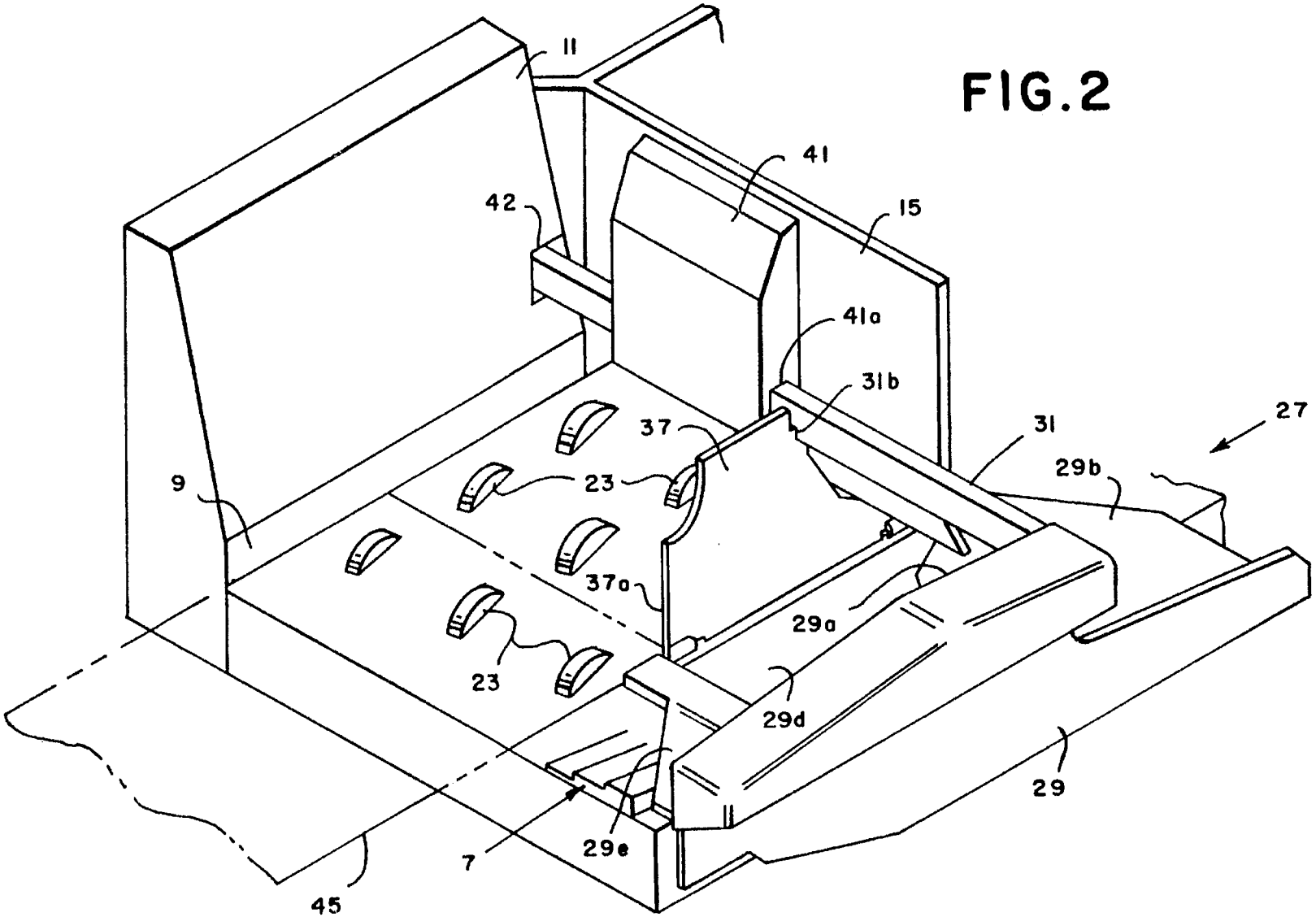
FIG. 2 is a perspective view of a front end feeder of a mail handling machine including the inventive side guide in a retracted position for registering narrow width pieces of mail.
Figure 3:
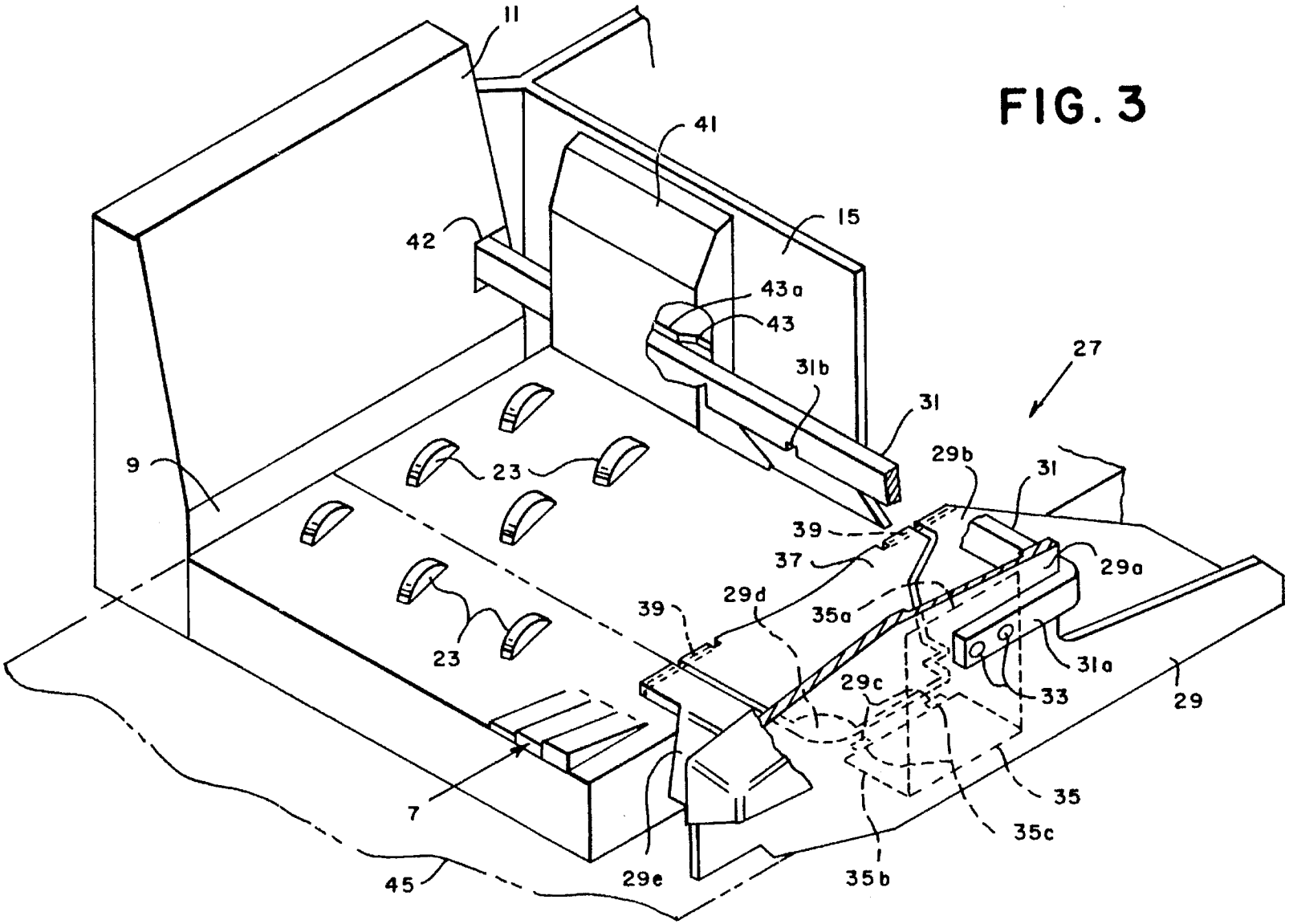
FIG. 3 is a perspective, partially cut-away view of the front end feeder of a mail handling machine including the inventive side guide in an extended position for registering mailpieces that are much wider than that of FIG. 2.

With reference to FIGS. 2 and 3, side guide 27 includes a main side guide 29 which is fixably attached to a slide bar 31. That is, a first leg **31*a* of slide bar 31 is attached to main side guide 29 by way of, for example, two screws 33. A right angle bracket 35 is also fixably attached via a first leg 35*a*, to a vertical wall 29*a* of main side guide 29 via the screws 33. A second leg 35*b* of right angle bracket 35 includes tab portions 35*c* which are disposed in notches 29*c* in horizontal wall 29*b* of main side guide 29. Right angle bracket 35 acts to reinforce the main side guide 29**.

An inner side guide 37 is pivotably mounted to horizontal wall **29*b* by two dowel pins 39. Thus, inner side guide 37 is free to pivot between an inoperative position as shown in FIG. 3 and an operative position as shown in FIG. 2. In the inoperative position, the inner side guide 37 has been rotated into a recess 29*d* formed in the horizontal wall 29*b*, the recess 29*d* generally corresponding to the shape of the inner side guide 37. In the inoperative position, a top surface 37*a* of the inner side guide 37 forms a substantially planner surface with a top surface of horizontal wall 29*b*** over which the mailpieces smoothly pass.

A winged section **29*e* extends from the horizontal wall 29*b* at a slight upwards angle. The upwardly angled portion is designed such that as the main side guide 29 is moved transverse to the downstream flow of the mailpieces it can pass over the step portion 7**.

A mounting unit 41 is attached to structure 15 in any conventional manner. Mounting unit 41 includes an opening 41 a extending completely therethrough and into which slide bar 31 is slidable disposed. A slot 42 is formed in tamper subsystem 11 to accommodate the slide bar 31 as shown in FIGS. 2 & 3.

Mounting unit 41 includes a friction spring 43 disposed therein. Friction spring 43 has a curved portion **43*a* which extends into the opening 41 a such that as slide bar 31 passes through opening 41 a it compresses curved portion 43*a* of friction spring 43. Curved portion 43*a* therefore applies a biasing force to slide bar 31 retaining it in place until a sufficient force is applied to slide bar in 31 in order to overcome the biasing force applied thereon by the friction spring 43. Thus, slide bar 31 can be infinitely positioned with respect to the width of the mailpieces passing through the mailing machine. In a preferred embodiment, side guide 27 is positionable via slide bar 31** to accommodate mailpieces ranging in width from approximately four to thirteen and one-half inches.

Referring to FIG. 2, inner side guide 37 is shown in its operative position as being substantially parallel to vertical wall **29*a* of main side guide 29. A notch 31*b* in slide bar 31 receives a top portion of inner side guide 37 thereby retaining inner side guide 37 in the position shown in FIG. 2**.

The operation of side guide 27 will hereinafter be described with reference to FIGS. 2 and 3. As noted above, and as shown in FIG. 3, when the inner side guide 37 is pivoted into recess **29*b*, it is in its inoperative mode. That is, inner side guide 37 will not participate in properly registering mailpieces against registration wall 9. Instead, vertical wall 29*a* of main side guide 29 will be used to assist in registering the mailpieces. In this configuration vertical wall 29*a* can be moved transverse to the downstream direction of the mailpieces by way of the slide bar 31 until it presses against an edge of a mailpiece 45. The movement of vertical wall 29*a* is generally considered adequate for registering mailpieces in a predetermined width range of approximately eight and one-half to thirteen and one-half inches. If a mailpiece less than eight and one-half inches in width is being processed, the main side guide 29 could not effectively be used since the horizontal portion 29*b* would strike the front friction drive wheel 23 prior to the vertical wall 29*a* butting against the edge of the narrow mailpiece. Thus, the main side guide 29 is not able to assist in the registration of smaller width mailpieces. Moreover, it is very important that the main side guide 27 be stabilized when it is extended outwardly to accommodate mail having a width of, for example, thirteen and one-half inches. Thus, the width of the horizontal wall 29*b* has been designed such that it will remain in contact with the top surface of deck 5 (as shown in FIG. 3) even when the main side guide 27 is fully extended to accommodate mailpieces having a maximum width. If the horizontal wall 29*b* were not situated on top of deck 5, the main side guide 29 would be very susceptible to the natural vibration of the mailing machine such that improper registration of the mailpiece could occur. Thus, it is important that the horizontal wall 29*b* remain in contact with the deck 5, which in turn limits the minimum width of a mailpiece that the main side guide 29 can accommodate because of interference with the friction drivewheels 23**.

In order to overcome the limitations of the main side guide 29, and with reference to FIG. 2, the inner side guide 37 is used to accommodate mailpieces having a width in a predetermined range of, for example, four to nine inches. When the inner side guide 37 it is pivoted into its operative position, it defines a vertical wall at the edge of horizontal wall **29*b* which is substantially parallel to vertical wall 29*a* and which can be moved into abutment with the smaller width envelopes. The vertical inner side guide 37 can be moved right up to the front friction drivewheels 23 to accommodate and register mailpieces as narrow as four inches. Moreover, since the inner side guide 37 is retained in the notch 35*a*, it provides the entire side guide structure 27** with increased rigidity to help overcome problems that could arise due to the natural vibration of the mail handling machine.

As described above, the inventive apparatus provides a structure which improves the registration of envelopes in mail handling machines which process varying width mailpieces. However, additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as deemed by the appended claims and their equivalents. For example, while the inner side guide is shown as being pivotably mounted to the main side guide, it could just as well be a removable member which is set in place when needed. Alternatively, the inner side guide could be pivotally connected to the slide bar. Moreover, while specific mailpiece width ranges for the preferred embodiment have been set forth herein, it will be obvious that different ranges of operations are possible based on the specific configuration of the mail handling machine and thus the invention is not limited to the mailpiece width ranges set forth herein.

What is claimed is:

1. A side guide for a mail handling machine, the side guide comprising:

a main wall;

a secondary wall spaced from said main wall and moveable between an operative position and an inoperative position;

means for allowing movement of said main and secondary walls in a direction transverse to movement of mailpieces passing through the mailing machine, said allowing means including 1) a slide bar connected to one of said main and secondary walls and 2) a mounting unit attached to the mailing machine, said slide bar slidably mounted within said mounting unit; and a third wall having a recess therein and being connected to said main wall at approximately a right angle, said secondary wall pivotably connected to said third wall to pivot between said operative position and said inoperative position, and said secondary wall being substantially parallel to said main wall in said operative position and being received in said recess and substantially parallel to said third wall in said inoperative position.

2. A side guide as recited in claim 1, wherein said slide bar has a notch therein which receives said secondary wall at times when said secondary wall is pivoted into said operative position.

3. In a mail handling machine having a front end feeder which feeds mailpieces through the mail handling machine, a side guide comprising:

a slide bar movably mounted to the mail handling machine proximate to the front end feeder, the slide bar being moveable transverse to movement of mailpieces through the mail handling machine;

a main side guide having a vertical wall and a horizontal wall, at least one of the vertical and horizontal walls connected to the slide bar such that the main side guide is moveable with the slide bar transverse to movement of mailpieces through the mailing handling machine; and an inner side guide mounted to said horizontal wall to be pivotable between a first position substantially parallel to said vertical wall and a second position substantially parallel to said horizontal wall;

wherein at times when said inner side guide is in said first position said slide bar is movable transverse to movement of mailpieces through the mail handling machine to position said inner side guide to abut against mailpieces having a width within a first pre-determined width range, and at times when said inner side guide is in said second position said slide bar is moveable transverse to movement of mailpieces through the mail handling machine to position said vertical wall to abut against mailpieces having a width within a second predetermined width range that is different from said first predetermined width range.

4. In a mail handling machine having a front end feeder which feeds mailpieces through the mail handling machine, a side guide comprising:

a slide bar movably mounted to the mail handling machine proximate to the front end feeder, the slide bar being moveable transverse to movement of mailpieces through the mail handling machine;

a main side guide having a vertical wall and a horizontal wall, at least one of the vertical and horizontal walls connected to the slide bar such that the main side guide is moveable with the slide bar transverse to movement of mailpieces through the mailing handling machine; and an inner side guide mounted to said horizontal wall to be pivotable between a first position and a second position;

wherein at times when said inner side guide is in said first position said slide bar is movable transverse to movement of mailpieces through the mail handling machine to position said inner side guide to abut against mailpieces having a width within a first pre-determined width range, and at times when said inner side guide is in said second position said slide bar is moveable transverse to movement of mailpieces through the mail handling machine to position said vertical wall to abut against mailpieces having a width within a second predetermined width range that is different from said first predetermined width range.

* * * * *